US007870952B2

(12) United States Patent
Fontana

(10) Patent No.: US 7,870,952 B2
(45) Date of Patent: Jan. 18, 2011

(54) PACKAGING THE EXTEMPORANEOUS PRODUCTS, PARTICULARLY MEDICINAL, PHARMACEUTICAL, COSMETIC PRODUCTS OR THE LIKE

(75) Inventor: Antonio Fontana, Carpi (IT)

(73) Assignee: Lameplast S.p.A., Novi di Modena (IT)

( * ) Notice: Subject to any disclaimer, the term of this patent is extended or adjusted under 35 U.S.C. 154(b) by 134 days.

(21) Appl. No.: 11/886,005

(22) PCT Filed: Mar. 15, 2006

(86) PCT No.: PCT/IB2006/000571

§ 371 (c)(1),
(2), (4) Date: Sep. 30, 2008

(87) PCT Pub. No.: WO2006/111803

PCT Pub. Date: Oct. 26, 2006

(65) Prior Publication Data

US 2010/0059394 A1 Mar. 11, 2010

(30) Foreign Application Priority Data

Mar. 15, 2005 (IT) ..... MO2005A0057

(51) Int. Cl.
*B65D 25/08* (2006.01)

(52) U.S. Cl. ..... 206/222; 206/219

(58) Field of Classification Search ..... 206/219, 206/222, 568, 216; 215/6, DIG. 8; 222/145.5, 222/80

See application file for complete search history.

(56) References Cited

U.S. PATENT DOCUMENTS

| | | | | |
|---|---|---|---|---|
| 3,156,369 | A | 11/1964 | Bowes et al. | |
| 3,603,469 | A * | 9/1971 | Magni | 206/222 |
| 5,217,433 | A | 6/1993 | Bunin | |
| 5,543,097 | A * | 8/1996 | Fang | 264/102 |
| 6,003,728 | A * | 12/1999 | Elliott | 222/81 |
| 6,148,996 | A * | 11/2000 | Morini | 206/222 |
| 6,152,296 | A * | 11/2000 | Shih | 206/222 |
| 6,540,070 | B1 * | 4/2003 | Conwell | 206/219 |
| 6,832,682 | B1 * | 12/2004 | Foster et al. | 206/219 |
| 6,854,595 | B2 * | 2/2005 | Kiser | 206/222 |
| 2002/0053524 | A1 * | 5/2002 | Alticosalian | 206/219 |
| 2004/0159562 | A1 * | 8/2004 | Takahashi et al. | 206/219 |
| 2005/0016875 | A1 * | 1/2005 | Rodriguez | 206/219 |
| 2005/0263414 | A1 * | 12/2005 | Harilela et al. | 206/221 |

FOREIGN PATENT DOCUMENTS

| | | |
|---|---|---|
| EP | 1186548 | 3/2002 |
| WO | 0053507 | 9/2000 |

OTHER PUBLICATIONS

English Abstract of EP 1186548.

* cited by examiner

*Primary Examiner*—David T Fidei
(74) *Attorney, Agent, or Firm*—Dykema Gossett PLLC

(57) ABSTRACT

The packaging for extemporaneous products, particularly medicinal, pharmaceutical, cosmetic products or the like, comprises a container of a first substance featuring a mouth, a receptacle of a second substance housed in said mouth, the inner volume of the receptacle being temporarily separated from the inner volume of the container and adapted to be placed in communication with this for mixing the first and second substance to form the product, and an isolating interspace defined along at least one portion of the surface delimiting the receptacle.

12 Claims, 9 Drawing Sheets

PACKAGING THE EXTEMPORANEOUS PRODUCTS, PARTICULARLY MEDICINAL, PHARMACEUTICAL, COSMETIC PRODUCTS OR THE LIKE

TECHNICAL FIELD

The object of this invention is a packaging for extemporaneous products, particularly medicinal, pharmaceutical, cosmetic products or the like.

BACKGROUND ART

A number of extemporaneous products, meaning products consisting of the solution or mixture of at least two different substances, of which, for instance, one in liquid state and the other in powder state, which are kept separate from each other until they are used, are known in the medicinal sector, the pharmaceutical sector and the cosmetic sector.

For such extemporaneous products, packagings are known essentially consisting of a container closed on the bottom and which extends at the top into a neck, at the top of which a mouth is defined; inside the container, a first substance is contained, generally in liquid state.

In the mouth of the container, a receptacle is housed of a second substance consisting of a hollow cylinder-shaped body, closed at the bottom by a breakable bottom and open at the top; the bottom of the receptacle, as long as this remains intact, separates the second substance from the first.

Inside the receptacle, a cutting element is sealed consisting of a tubular body, the bottom end of which is sectioned according to an oblique plane or shaped like the beak of a flute, the upper end of which extends beyond the upper end of the receptacle. The cutting element slides axially compared to the receptacle between a non-interference configuration, in which it is placed above the intact bottom of the receptacle, and a cutting configuration, in which, pushed towards the bottom of the receptacle, it cuts this along the surrounding edge thereby placing the thus-opened receptacle in communication with the container.

The known packagings also feature a cover cap associated with the container neck by means of a threaded coupling; the lower edge of the cap is temporarily fastened, along a breakage line, to a seal ring fastened to the container neck and featuring a weakened axial line at which point it opens.

Finally, inside the cap, a ring-shaped raised part is defined which, after the cap has been screwed onto the neck of the container, is coupled with the top edge of the receptacle, which is elastically deformable in centripetal direction, to form with this a single body.

When the time comes to use the product, the cap is screwed onto the neck of the container thereby breaking the ring seal which detaches and opens. The screwing up of the cap causes the sliding of the cutting element inside the receptacle until the bottom of this is cut; the second substance thus pours from the receptacle into the container inside which it mixes with the former substance, forming the product. To dispense the product thus formed, the cap simply has to be unscrewed to extract, together with the cap, also the receptacle and the cutting element opening the container dispenser mouth.

These known type packagings are not free of drawbacks, including the fact that, while keeping the two components making up the product separate until preparation of the latter, they do not permit isolating the one from the other.

More specifically, the vapours released by the liquid substance in the container partially permeate the inside of the receptacle where a powdery substance, often hygroscopic, is generally present.

Before product preparation, while the two substance are still separate, the powdery substance absorbs the vapours released by the liquid substance, becoming impregnated and thickening into agglomerates. When the time comes to prepare the product and the receptacle is opened and placed in communication with the container, the agglomerates that have formed tend to remain inside the receptacle and, even when they have shifted into the container, find it hard to dissolve and disperse completely in the liquid substance.

The composition of the thus-formed product does not correspond to that provided; in the event of the product being a pharmaceutical or medicinal product, this causes an indeterminable alteration of the contents of its active ingredients, as well as of the established dosage and, therefore, a disadvantageous modification of the therapy studied for a patient.

This problem is worsened by the fact that the receptacles of known packagings are generally made of polymer materials featuring a certain degree of permeability to vapours. The permeability to vapours is further accentuated at the bottom of the receptacle which, being breakable, is normally of low thickness and/or attached to the body of the receptacle along lines of extra-weak thickness.

DISCLOSURE OF THE INVENTION

The aim of the present invention is to eliminate the above-indicated drawbacks of the known packagings by providing a packaging for extemporaneous products, particularly medicinal, pharmaceutical, cosmetic products or the like, that permits keeping the substances making up the product perfectly separated and isolated until the preparation of the product.

The purpose of the present invention consists in providing a packaging that permits, in particular, preventing the absorption by a substance, generally the powdery and hygroscopic substance, of the vapours released by another, generally liquid substance and, therefore, the formation of undesired thickening and agglomerates.

Another purpose of the present invention consists in inventing a packaging that permits preparing a product of required composition and, therefore, especially medicinal or pharmaceutical products with a pre-established content of active ingredients, thus making it possible to respect the dosage set for patient therapy.

Another purpose of the present invention consists in providing a packaging that can be easily and conveniently used and opened by users without any special effort on their part.

Within such technical aim, another purpose of the present invention is to cater for the previous aims with a simple structure, of relatively easy practical implementation, safe and effective to use and work, as well as having a fairly low cost.

This aim and these purposes are all achieved by the present packaging for extemporaneous products, particularly medicinal, pharmaceutical, cosmetic products or the like, comprising a container of a first substance which is provided with a mouth and a receptacle of a second substance which is housed in said mouth, the inner volume of the receptacle being temporarily separated from the inner volume of the container and adapted to be placed in communication with it for mixing the first and the second substance to form a product, characterized in that it comprises an isolating interspace defined along at least one portion of the surface delimiting said receptacle.

BRIEF DESCRIPTION OF THE DRAWINGS

Further characteristics and advantages of the present invention will appear even more evident from the detailed description of some preferred, but not exclusive, embodiments of a packaging for extemporaneous products, particularly medicinal, pharmaceutical, cosmetic products and the like, illustrated by way of non limiting example in the accompanying drawings, wherein.

WAYS OF CARRYING OUT THE INVENTION

Figure 1:
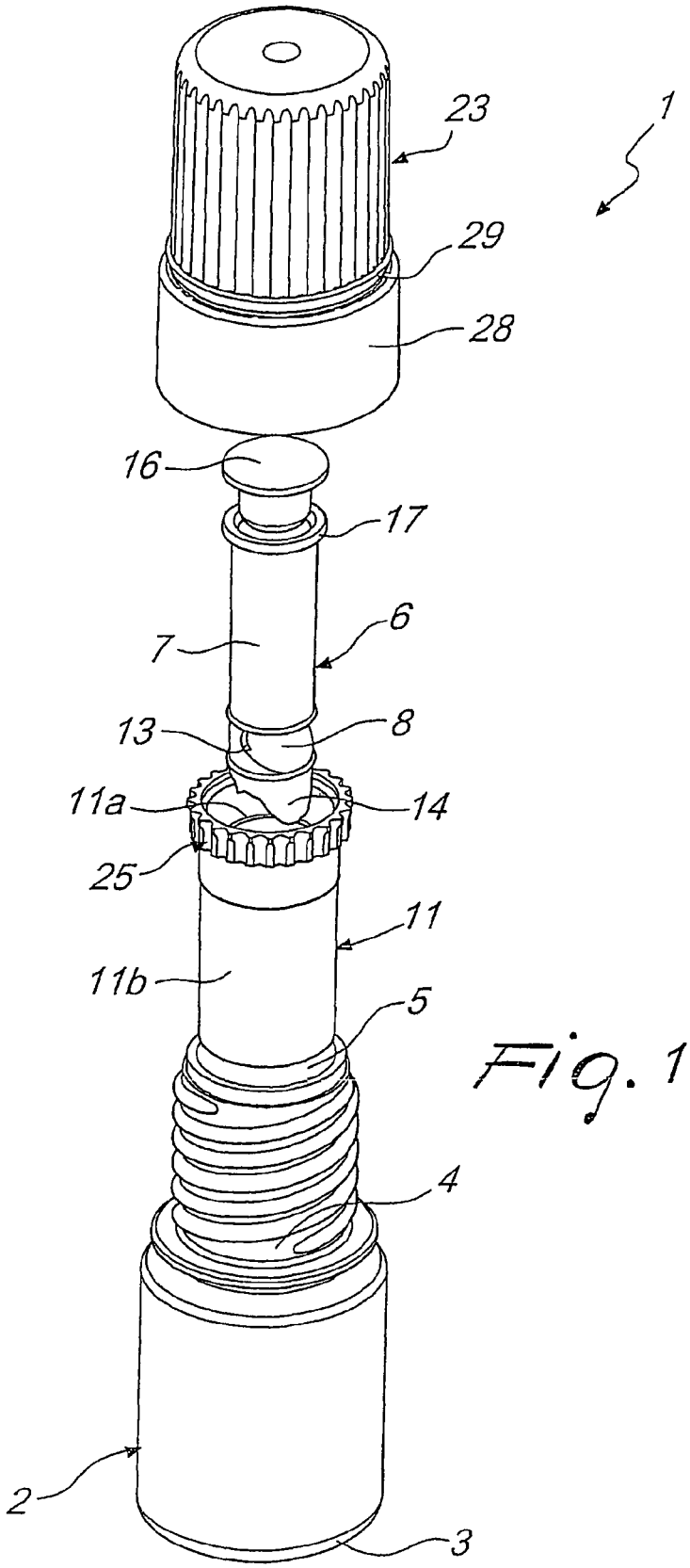
FIG. 1 is an axonometric and exploded view of a first embodiment of the packaging according to the invention in which the receptacle is of the sliding type and features a bottom and side interspace, the removal of the receptacle from the container being independent of and subsequent to that of the cap.

With special reference to such figures, the reference numeral 1 generally designates a packaging for extemporaneous products, particularly medicinal, pharmaceutical, cosmetic products and the like By extemporaneous products is meant products obtainable by the solution or mixing of at least two different substances that are kept separate until the product is used. One of the two substances, the solute, is generally in powder or granular form, while the other, the solvent, is generally in liquid form; other different cases cannot however be excluded in which both substances are in powder or granular or liquid form.

The packaging 1 comprises a container 2 of a first substance having substantially the shape of a phial or a bottle closed below by a base 3 and which extends in a neck 4 at the top of which a dispenser mouth 5 is defined for the product, once this is prepared.

Inside the mouth 5 is housed a receptacle 6 of a second substance, the internal volume 6*a* of the receptacle 6 is temporarily separated from the internal volume 2*a* of the container 2 and is adapted to be placed in communication with this for mixing the first and second substance to form the product.

The receptacle 6 consists of a substantially cylindrical body that is hollow inside and delimited by walls 7 and which has its end turned towards the inside of the container 2 closed by a bottom 8.

In at least one portion of the surface delimiting the receptacle 6 an isolating interspace is defined; more specifically, this interspace comprises a bottom interspace 9, defined in the bottom 8 and/or a side interspace 10 defined in walls 7.

In the first and second embodiment of the packaging 1 (FIGS. 1-6 and 13) the receptacle 6 is inserted sliding axially in a guide bush 11 housed inside the mouth 5 and which has its end turned towards the inside of the container 2 closed by a closing element 12 of the removable or breakable type.

The bottom 8 of the receptacle 6 lies on an inclined surface with respect to the longitudinal axis of the receptacle itself; starling from a section of the perimeter of the bottom 8 containing the point less distant from the surface of the container 2 opposite it, meaning from the base 3, a window 13 opens in walls 7, the lower edge of which coincides with this section.

Figure 3:
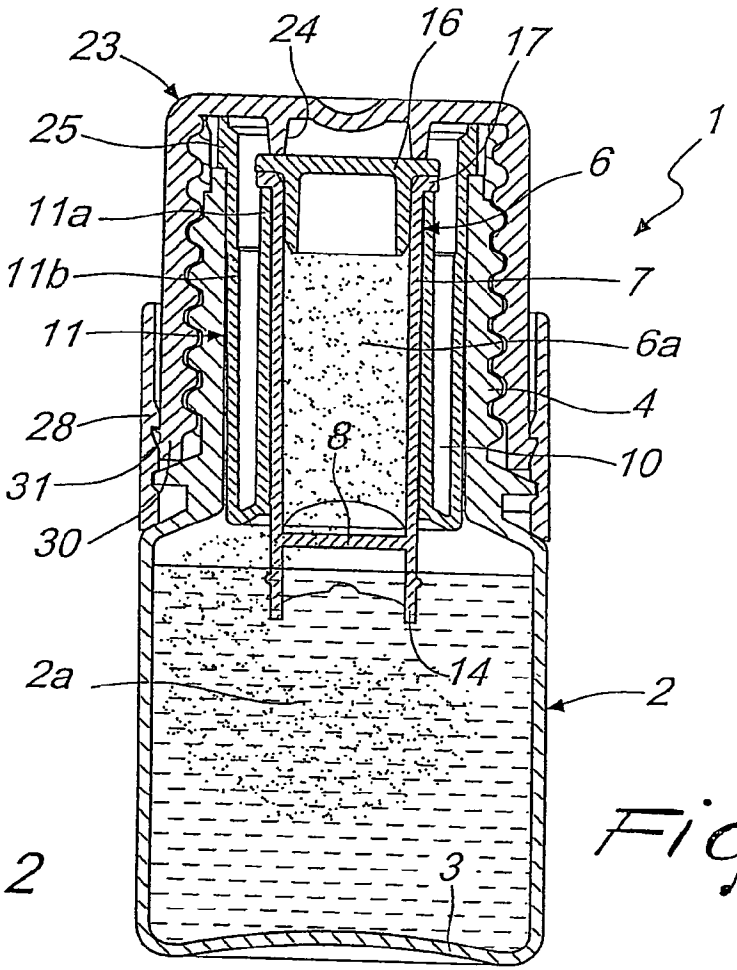
FIG. 3 is a section view of the packaging of FIG. 1 closed after the preparation of the product.
Figure 2:
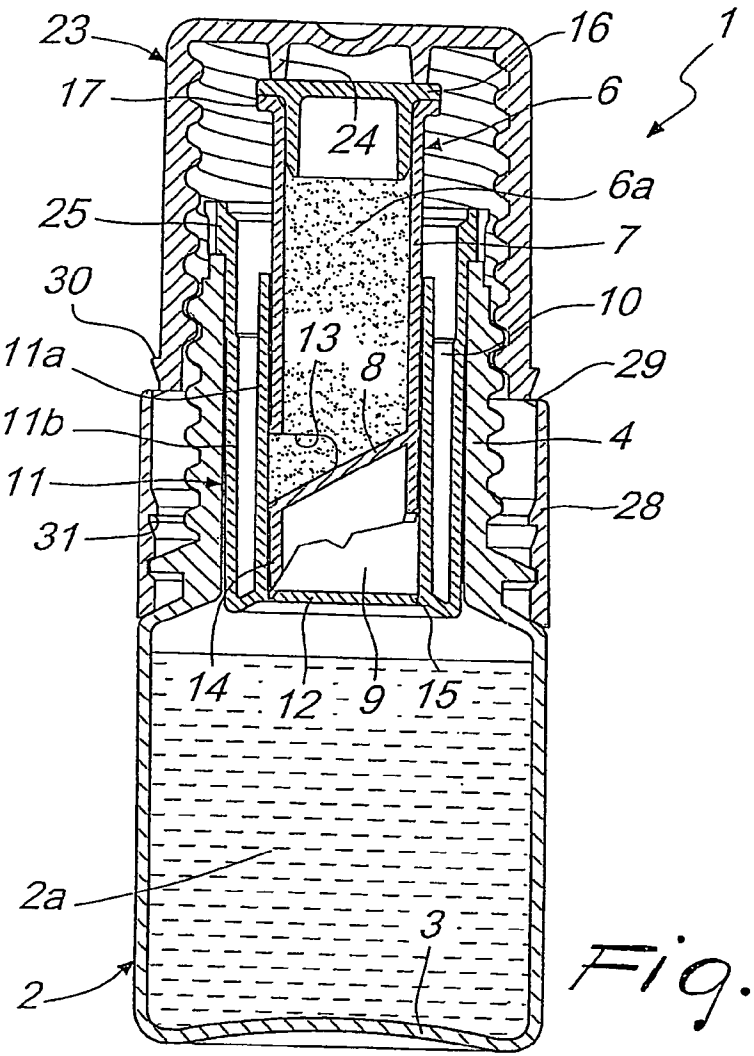
FIG. 2 is a section view of the packaging of FIG. 1 closed before the preparation of the product.
Figure 4:
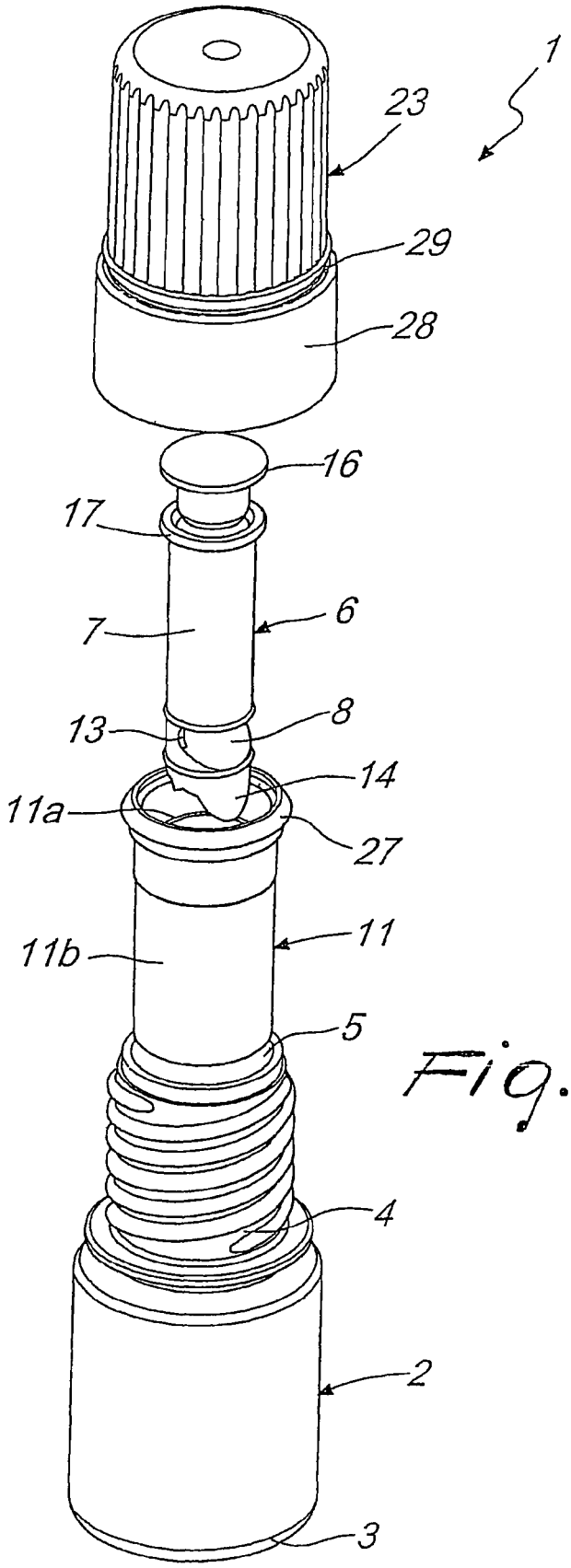
FIG. 4 is an axonometric and exploded view of a second embodiment of the packaging according to the invention in which the receptacle is of the sliding type and features a bottom and side interspace, the receptacle being removed from the container jointly with the cap.
Figure 6:
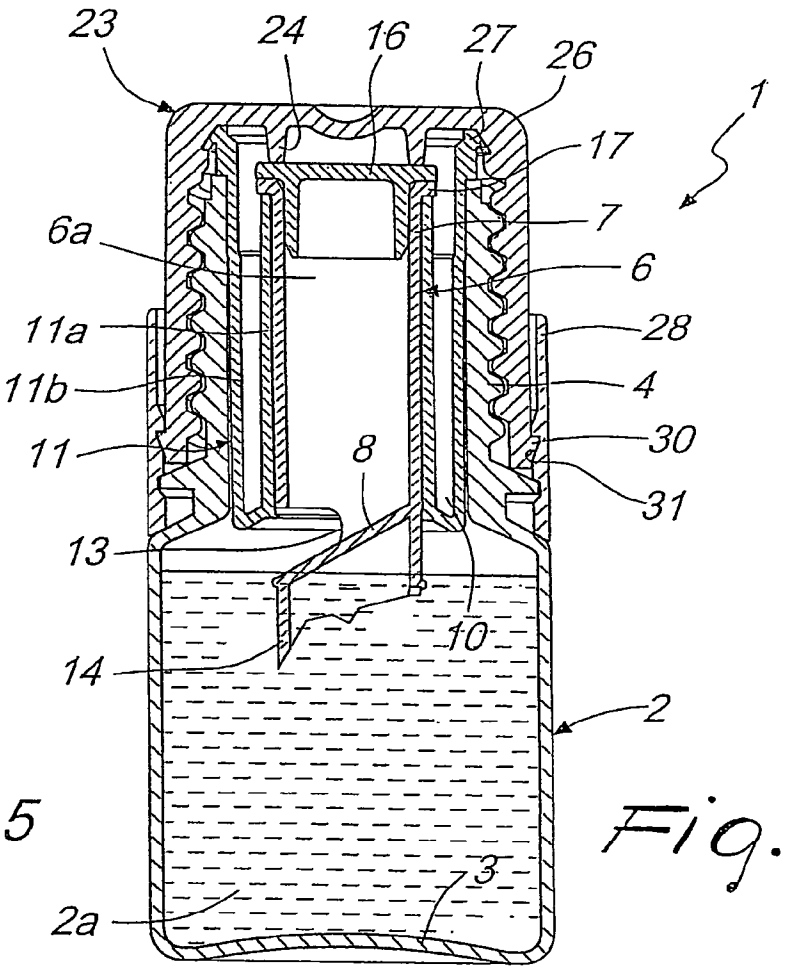
FIG. 6 is a section view of the packaging of FIG. 4 closed after the preparation of the product.
Figure 5:
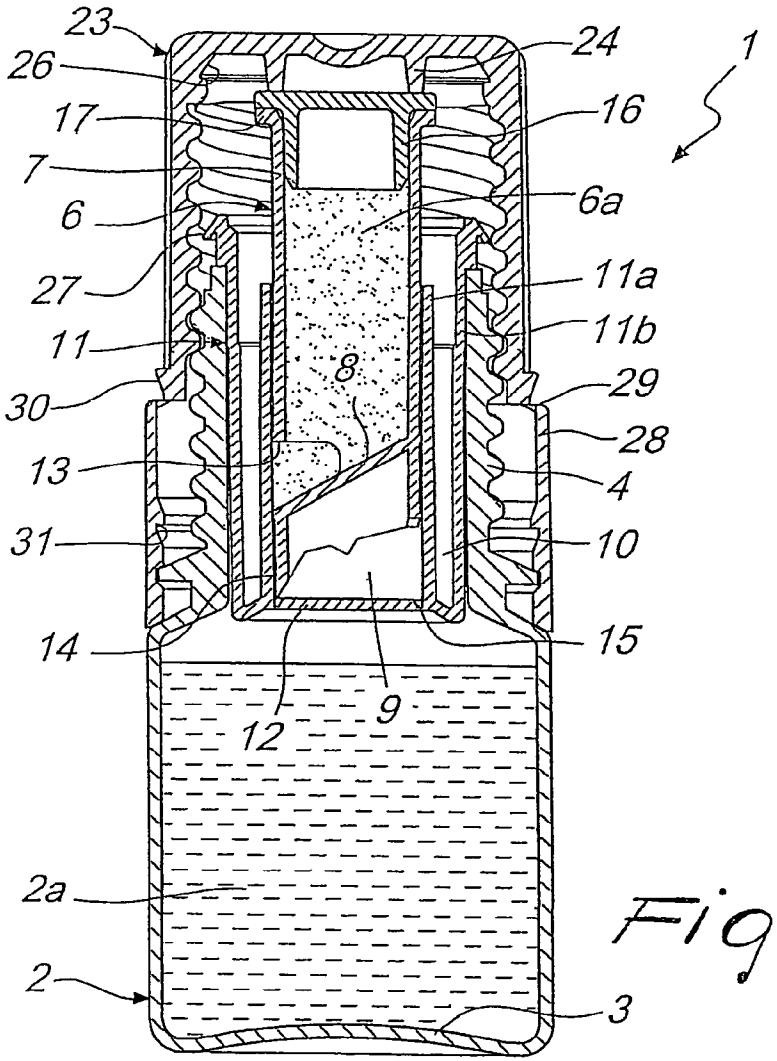
FIG. 5 is a section view of the packaging of FIG. 4 closed before the preparation of the product.
Figure 7:
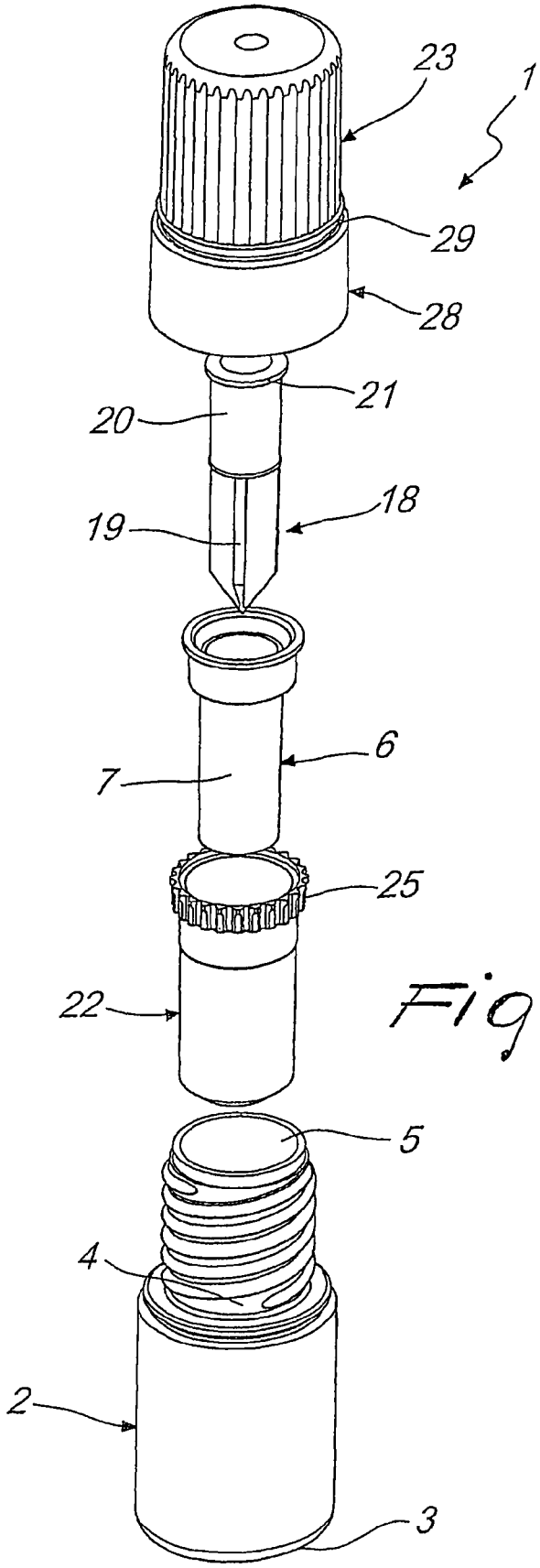
FIG. 7 is an axonometric and exploded view of a third embodiment of the packaging according to the invention in which the receptacle is fixed and of the type with breakable bottom and features a bottom and side interspace, the removal of the receptacle from the container being independent of and subsequent to that of the cap.
Figure 9:
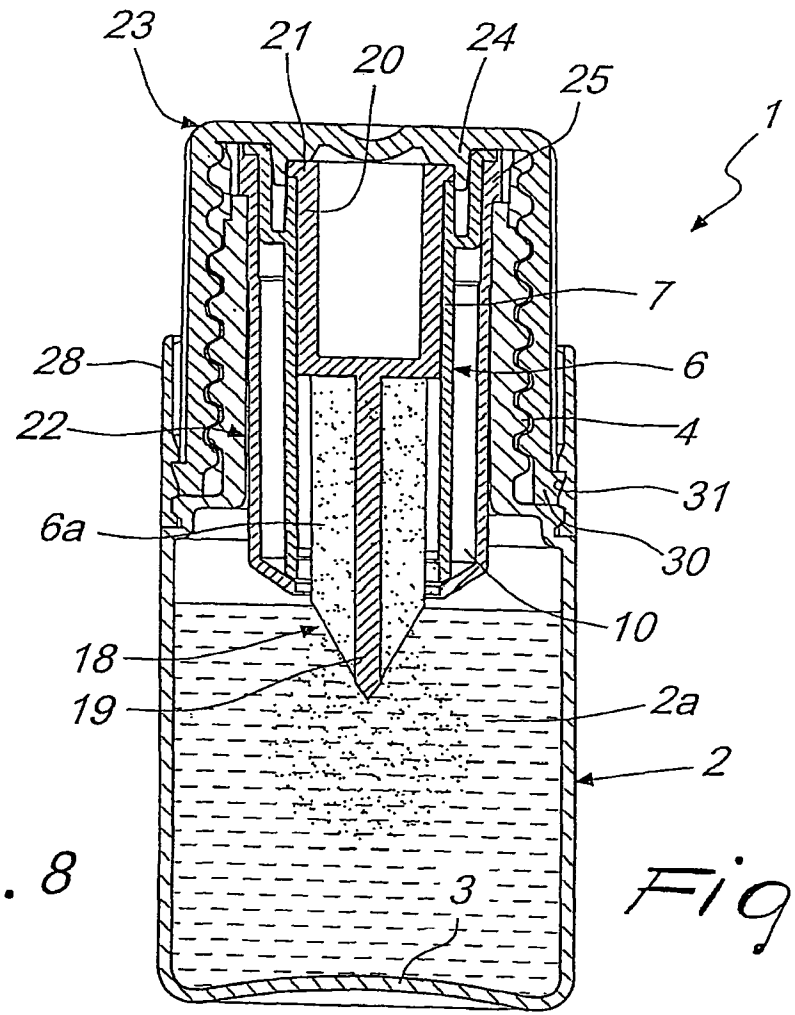
FIG. 9 is a section view of the packaging of FIG. 7 closed after the preparation of the product.
Figure 8:
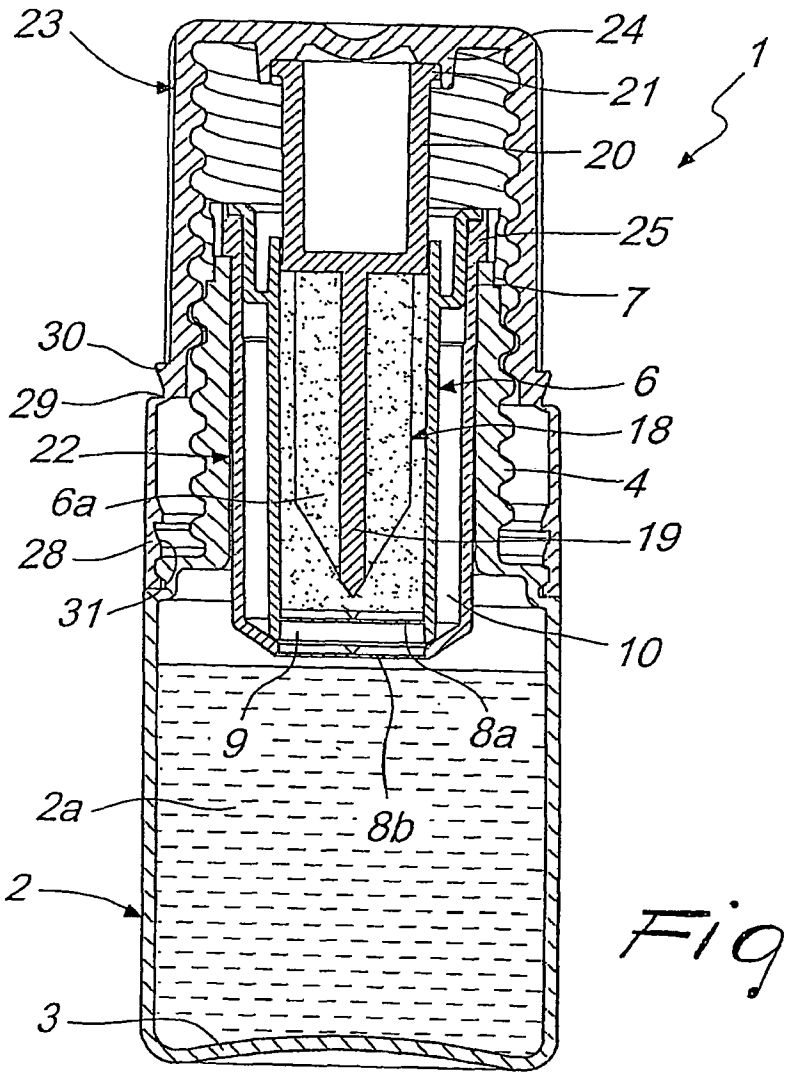
FIG. 8 is a section view of the packaging of FIG. 7 closed before the preparation of the product.
Figure 10:
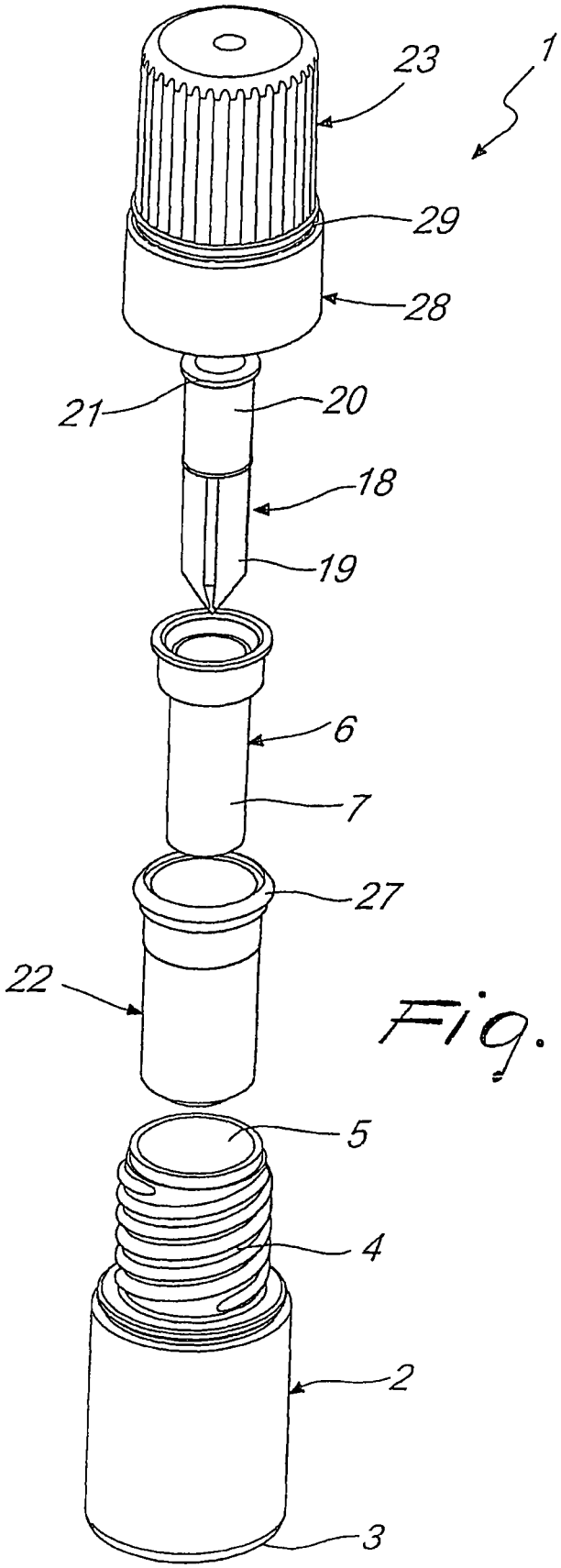
FIG. 10 is an axonometric and exploded view of a fourth embodiment of the packaging according to the invention in which the receptacle is fixed and of the type with breakable bottom and features a bottom and side interspace, the receptacle being removed by the container jointly with the cap.
Figure 12:
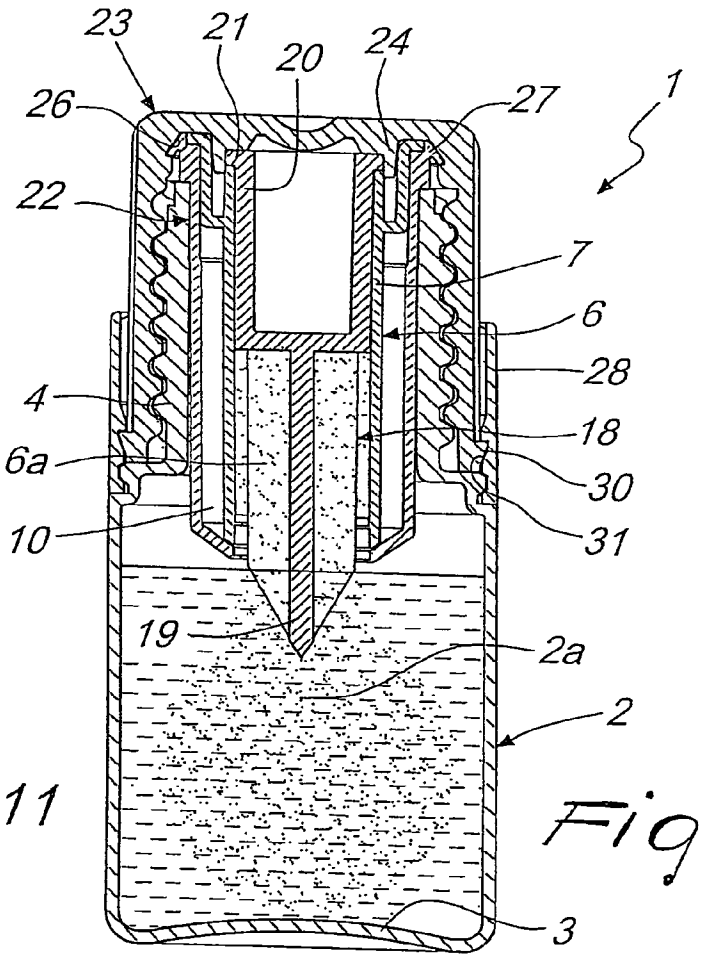
FIG. 12 is a section view of the packaging of FIG. 10 closed after the preparation of the product.
Figure 11:
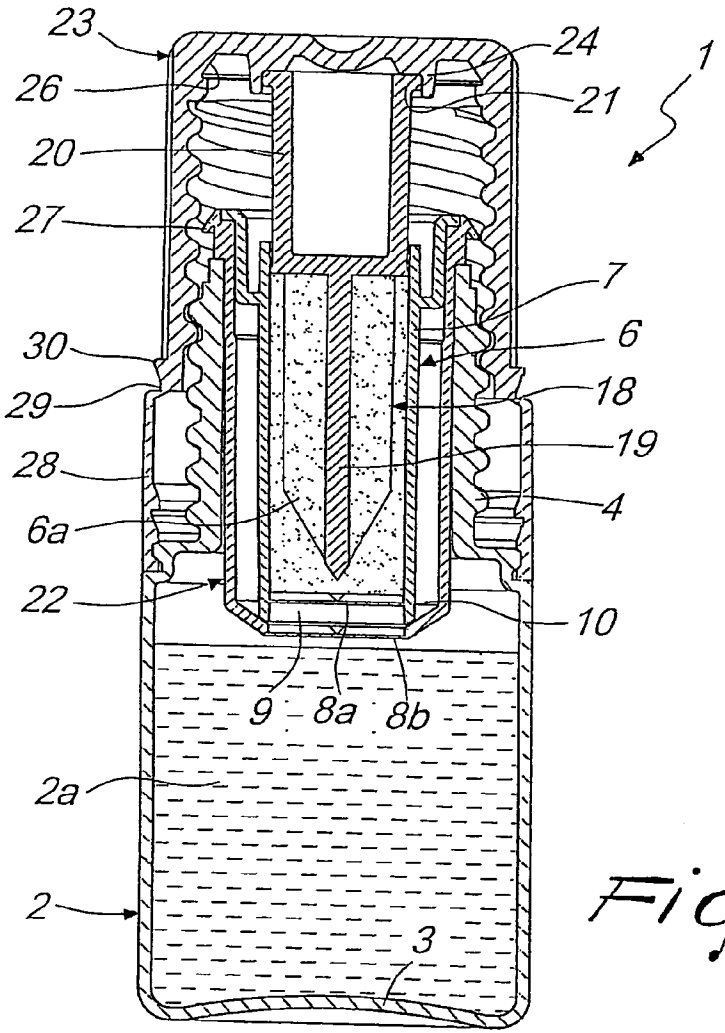
FIG. 11 is a section view of the packaging of FIG. 10 closed before the preparation of the product.

The receptacle 6 slides between a containment and isolation configuration of the second substance (FIGS. 2, 5 and 13) and a release configuration of the second substance (FIGS. 3 and 6).

In the containment and isolation configuration, the receptacle 6 is refracted in the bush 11, the window 13 is closed by the walls of the bush 11 and the bottom interspace 9 is defined between the closing element 12 and the bottom 8.

In the release configuration the receptacle 6, the closing element 12 having been removed or broken, is protracted beyond the end of the bush 11 turned towards the inside of the container 2 with the window 13 uncovered to allow the fall of the second substance into the container 2.

In a preferred form of embodiment, the bush 11 comprises double side walls, 11*a* and 11*b*, between which is defined the side interspace 10. The internal side wall 11*a* has a height below that of the external side wall 11*b*, the latter terminating, at the end turned towards the outside of the container 2, in a ring-shaped enlargement resting on the edge of the mouth 5.

Different embodiments of the side interspace 10 are not to be excluded however; this, for instance, could be defined by a liner wrapped around the outside of the bush 11.

In the first and second form of embodiment of the packaging 1, the receptacle 6 can feature the bottom interspace 9 only, or the bottom interspace 9 and the side interspace 10.

Always with reference to the first and the second form of embodiment of packaging 1, the bottom 8 extends, on the side opposite to that of the body of the receptacle 6, into a push element 14 adapted to interact with the closing element 12 of the bush 11 to remove or break this and which, when the receptacle 6 is in the second substance containment and isolation configuration, is housed in the bottom interspace 9.

Figure 13:
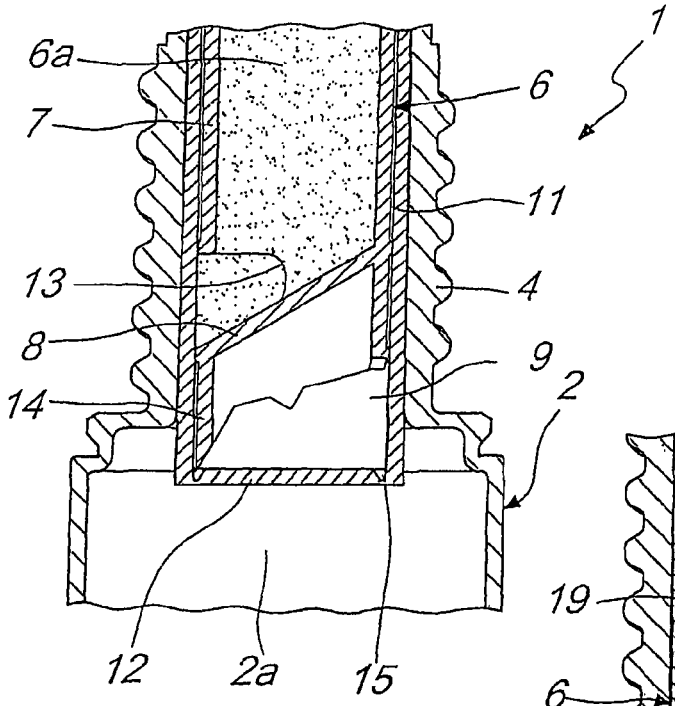
FIG. 13 is a section on enlarged scale of a detail of a possible alternative to the first and second embodiment of the packaging according to the invention, in which the receptacle features a bottom interspace only.
Figure 14:
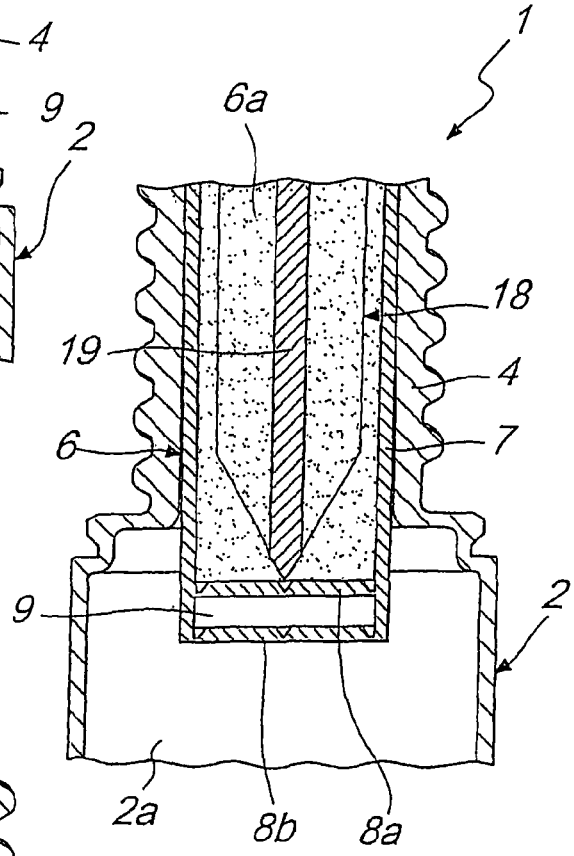
FIG. 14 is a section on enlarged scale of a detail of a possible alternative to the third and fourth embodiment of the packaging according to the invention, in which the receptacle features a bottom interspace only.
Figure 15:
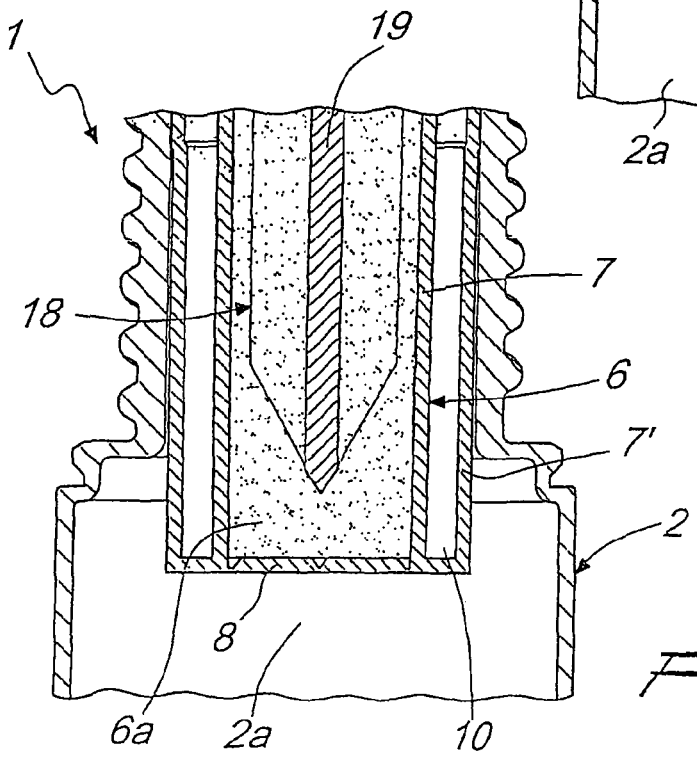
FIG. 15 is a section on enlarged scale of a detail of a further possible alternative to the third and fourth embodiment of the packaging according to the invention, in which the receptacle features a side interspace only.

In the particular form of embodiment represented in FIGS. 1-6 and in FIG. 13, the closing element 12 consists of a disc fastened to the perimeter of the end of the bush 11 turned towards the inside of the container 2 along a weakened band 15, while the push element 14 consists of a cylindrical appendix substantially shaped like the beak of a flute or similar and which is adapted to cut the closing element 12 at the point of the weakened band 15.

The end of the body of the receptacle 6 turned towards the outside of container 2 is open to allow filling of the receptacle 6 with the second substance during packing and assembly of the packaging 1, and after filling this is closed by a shutter 16 of the one cap or similar type.

Near the end of the receptacle 6 turned towards the outside of the container 2 a collar 17 is defined for stopping sliding of the receptacle 6 and which is adapted to rest on the edge of the bush 11.

In the third and fourth form of embodiment of packaging 1 (FIGS. 7-12, 14 and 15) the receptacle 6 is fixed and its bottom 8 is of the breakable type.

In these forms of embodiment, the end of the body of the receptacle 6 turned towards the outside of the container 2 is open to allow the transit through it of a push body 18 adapted to interact with the bottom 8.

The push body 18 is axially housed sliding inside the receptacle 6 between a configuration retracted inside it (FIGS. 8, 11, 14 and 15), in which it does not interact with the bottom 8, and a configuration protracted beyond the end of the receptacle 6 turned towards the inside of the container 2 (FIGS. 9 and 12) in which it interacts with the bottom 8 for its breakage.

In particular, the push body 18 comprises a stem 19 with a usefully cross-shaped cross section; the end of the stem 19 turned towards the bottom 8 has a pointed shape, while its opposite end widens into a cylindrical enlargement 20, fitted, sliding and substantially sealed, in the end of the receptacle 6 turned towards the outside of the container 2, closing it, and which widens into a stop ring 21 for stopping the sliding of the push body itself adapted to rest on the edge of the receptacle 6.

In a preferred form of embodiment (FIG. 14), the bottom 8 of the receptacle 6 is double, and specifically comprises a first breakable bottom 8*a* and a second breakable bottom 8*b* which are superimposed parallel at a preset distance from one another; the space they delimit defines the bottom interspace 9. The first bottom 8*a* and the second bottom 8*b* are broken in succession, one before the other, by the push body 18 sliding from its retracted configuration to its protracted configuration.

In another preferred form of embodiment (FIG. 15) the body of the receptacle 6 comprises double side walls 7 and T between which is defined the side interspace 10, the bottom 8 being single, not double, and the bottom interspace 9 therefore being absent.

In another preferred form of embodiment (FIG. 7-12) the body of the receptacle 6 is fitted in a substantially cylindrical liner 22, housed in the mouth 5; the receptacle 6 is coupled with the liner 22, the opposite ends of the receptacle 6 being substantially coupled and sealed with the corresponding ends of the liner 22.

The inner diameter of the walls of the liner 22 is substantially higher than the outer diameter of the walls 7 of the receptacle 6 so as to define a space around these representing the side interspace 10.

The breakable bottom 8 of the receptacle 6 is, furthermore, of double type to define the interspace of the bottom 9; in this case, the first bottom 8*a* is defined near the end of the receptacle 6 turned towards the inside of the container 2, while the bottom 8*b* is defined close to the corresponding end of the liner 22.

The bottom 8 or the first bottom 8*a* and the second bottom 8*b* are fastened to the receptacle 6 or, in the case of the second bottom 8*b*, to the liner 22 along weakened lines with facilitated breakage and usefully present a central indentation on which acts the tip of the stem 19.

In the third and fourth form of embodiment the receptacle 6 can feature bottom interspace 9 only, side interspace 10 only or both of these.

The packaging 1 then comprises a cap 23 covering the mouth 5, which is of the removable type and is associated with the neck 4 of the container 2 with a threaded coupling.

The inner surface of the crown of the cap 23 features an appendix 24 associated with the end which is turned towards the outside of the container 2, or of the sliding receptacle 6 (FIGS. 1-6 and 13), in which case it rests specifically on the shutter 16, or of the push body 18 (FIGS. 7-12, 14 and 15), in which case it embraces the end of the cylindrical enlargement 20.

In the first and second form of embodiment of the packaging 1, by screwing up the cap 23 on the neck 4, the appendix 24 exercises a corresponding push action on the receptacle 6 of the sliding type causing this to slide inside the bush 11 from the containment and insulation configuration to that of release of the second substance.

In the third and fourth form of embodiment of the packaging 1, by screwing up the cap 23 on the neck 4, the appendix 24 exercises a pushing action on the push body 18 such as to cause this to slide inside the fixed receptacle 6, with the bottom 8, single or double, of the breakable type, from retracted configuration to protracted configuration.

In the first and third embodiment of packaging 1, at the end of product preparation, the extraction from the mouth 5 of the bush 11, together with the receptacle 6 fitted in this, or the liner 22, together with the receptacle 6 which is integral with this, only occurs once the cap 23 has been removed.

For this purpose, on the outer side surface of the end turned towards the outside of the container 2 of the bush 11 and the liner 22 respectively a handgrip 25 is obtained, with usefully knurled surface, adapted to ensure easier grip by a user.

In the second and fourth embodiment of the packaging 1, on the other hand, at the end of product preparation, the extraction from the mouth 5 of the bush 11, together with the receptacle 6 fitted in this, or of the liner 22, together with the receptacle 6 which is integral with this, occurs in an integral way and at the same time as the removal of the cap 23.

Inside the cap 23 is in fact defined a cavity 26, usefully ring shaped, into which, once screwing has been completed, a corresponding tooth 27 is slotted, this too ring shaped, which is defined protruding at the end turned towards the outside of the container 2 of the bush 11 or of the liner 22 respectively. Finally, the cap 23 comprises a seal ring 28 temporarily fastened to this along a breakable line 29 temporarily fastened to the neck 4 of the container 2.

The seal ring 28 has an inner diameter greater than the outer diameter of the cap 23, a fixing coupling being defined between these and adapted to couple up once screwing of the cap 23 has been completed. Such coupling consists, for instance, of a ring-shaped raised part 30 defined as protruding from the outer surface of the cap 23 and of a corresponding ring-shaped groove 31 defined inside the seal ring 28.

The operation of the invention is the following.

Making reference to the first and second form of embodiment of the packaging 1, the assembly and packaging of this must be done by introducing a prefixed quantity of first substance in the container 2 and then, subsequently, fitting the bush 11 in the mouth 5.

The receptacle 6, with open end opposite the bottom 8, is then fitted in the bush 11. This is then filled with a prefixed quantity of the second substance and closed with a shutter 16.

Finally the cap 23, integral in a single body with the seal ring 28, is fitted on the neck 4.

In this closed configuration (FIGS. 2 and 5), the second substance is contained and isolated from the first thanks to the presence of the bottom interspace 9 and, possibly, of the side interspace 10.

When the product has to be prepared, the cap 23 must be screwed onto the neck 4, thereby breaking the breakable line 29 which releases it from the seal ring 28; following the screwing on of the cap 23 its inner appendix 24 exercises a pushing action on the receptacle 6 such as to cause its sliding inside the bush 11.

During the first section of the sliding stroke of the receptacle 6, the pushing element 14 cuts the weakened band 15 that fastens the closing element 12 to the bush 11 releasing it.

The closing element 12 remains fastened along a section of its perimeter to the edge of the mouth 11. During the subsequent section of sliding stroke of the receptacle 6 the window 13 is uncovered by the bush 11, so that the second substance contained in the receptacle 6 pours inside the container 2 to form the product. The emptying of the receptacle 6 is made easier by the inclination of the bottom 8 which acts as a chute for the second substance. The stroke of the receptacle 6 is stopped by the stop of the collar 17 on the edge of the bush 11.

To dispense the thus prepared product the cap 23 simply has to be unscrewed from the neck 4.

In the first form of embodiment, the cap 23 is removed before and independently from the bush 11 and, therefore, from the receptacle 6 fitted in it, to remove which, it will be necessary to take hold of the handgrip 25 and perform a substantially traction action.

In the second form of embodiment at the end of the screwing of cap 23 on the neck 4 the tooth 27 couples by slotting into the cavity 26 making the bush 11 integral with the cap 23; the extraction of the bush 11 from the mouth 5 and, therefore, of the receptacle 6 fitted in it, occurs integrally and at the same time as the removal of the cap 23.

In both the first and second form of embodiment, at the end of the screwing of the cap 23 on the neck 4, the ring-shaped raised part 30 couples with the ring-shaped groove 31; the seal ring 28 is thus fastened to the cap 23. When the cap 23 is removed, the coupling between the seal ring 28 and the neck 4 yields, while that between it and the cap 23 remains stable; the seal ring 28 is, therefore, removed together with the cap itself.

Referring now to the third and fourth form of embodiment of packaging 1, its assembly and packaging are done by introducing a preset quantity of the first substance in the container 2 and, afterwards, fitting in the mouth 5 the liner 22, inside which the receptacle 6 is coupled integrally. After filling the receptacle 6 with a preset quantity of the second substance, the push body 18 is fitted inside it, the cylindrical enlargement 20 of which acts as a closing for the receptacle itself.

Finally the cap 23, which is integral in a single body with the seal ring 28, is fitted on the neck 4.

In this closed configuration (FIGS. 7 and 10) the second substance is contained and isolated from the first thanks to the presence of the bottom interspace 9 or the side interspace 10 or both.

When the product has to be prepared, the cap 23 has to be screwed onto the neck 4, thereby breaking the breakable line 29 which releases it from the seal ring 28; following the screwing up of the cap 23 its inner appendix 24 exercises a pushing action on the push body 18 such as to cause its sliding inside the receptacle 6.

The push body 18 breaks the bottom 8 or, in succession, the first bottom 8*a* and the second bottom 8*b*, so the second substance falls in the container 2 where it mixes with the first to form the product.

The bottom 8 or the first bottom 8*a* and second bottom 8*b* break into pieces, each of which remains fastened, by its own section of circular perimeter to the edge of the end of the receptacle 6 or of the liner 22 turned towards the inside of the container 2.

The stroke of the push body 18 is stopped by the stop of the stop ring 21 on the edge of the receptacle 6.

To dispense the product thus prepared, the cap 23 has simply to be unscrew from the neck 4.

In the third form of embodiment the cap 23 is removed before and independently from the liner 22 and, therefore, from the receptacle 6 which is integral with it, to take off which it is necessary to hold the handgrip 25 and to exercise a substantially traction action.

In the fourth form of embodiment at the end of screwing up of the cap 23 on the neck 4 the tooth 27 couples by slotting in the cavity 26 making the liner 22 integral with the cap 23; the removal from the mouth 5 of the liner 22 and, therefore, of the receptacle 6 which is integral with it, occurs integrally and at the same time as the removal of the cap 23.

It should be noticed that the bottom interspace 9 could act as a receptacle of a third substance making up the product.

In both the third and fourth form of embodiment at the end of screwing up of the cap 23 on the neck 4, the ring-shaped raised part 30 couples with the ring-shaped groove 31; the seal ring 28 is thus fastened to the cap 23. When the cap 23 is removed, the coupling between the seal ring 28 and the neck 4 yields, while that between it and the cap 23 remains stable; the seal ring 28 is then removed together with the cap itself.

In practice, it has been found that the described invention achieves the intended aim and objects.

The packaging according to the invention does in fact permit keeping the substances that make up the product separate and perfectly isolated until the time comes to prepare the product.

The bottom and/or side interspaces covering the bottom and/or walls of the receptacle do in fact permit to isolate perfectly the second substance from the first as long as these are separated from each other.

The packaging according to the invention thus prevents a substance absorbing the vapours released by the other and prevents the formation of thickenings and agglomerates and guarantees the complete dissolution of the one in the other. The packaging according to the invention therefore guarantees the preparation of a product of desired composition and, in the particular case of medicinal or pharmaceutical products, with a preset content of active ingredients, so as to observe the dosage set for patient therapy.

The packaging according to the invention is, finally, practical and easy to use and requires no particular effort on the part of users.

The invention thus conceived is susceptible of numerous modifications and variations, all of which falling within the scope of the inventive concept.

Furthermore all the details can be replaced with others that are technically equivalent.

In practice, the materials used, as well as the shapes and dimensions, may be any according to requirements without because of this moving outside the protection scope of the following claims.

The disclosures of the Italian Patent Application no. MO2005A000057, the priority of which is claimed by this application, are incorporated herein by reference.

The invention claimed is:

1. A packaging for extemporaneous products comprising, a container for a first substance, said container defining an inner volume and a mouth, a guide bush located in said mouth of said container, said guide bush having a breakable or removable closing element at an end thereof facing said inner volume of said container, and a receptacle for a second substance slidingly located in said guide bush, said receptacle comprising a substantially cylindrical hollow body having a side wall and a bottom wall near an end of said side wall facing said closing element of said guide bush, said bottom wall and said closing element defining a bottom interspace therebetween, and a window facing said guide bush, said receptacle being moveable in said guide bush toward the inner volume of said container from a first retracted position in said guide bush wherein said window is closed by said guide bush and said closing element is intact to a second release position wherein said closing element has been severed from said guide bush and said window opened to the inner volume of said container so as to release said second substance therein to mix with said first substance in said container and form a product.

2. The packaging according to claim 1, wherein said bush comprises double side walls between which is defined as a side interspace.

3. The packaging according to claim 1, wherein said bottom wall is inclined with respect to an axis of said body, and said window has one side extending along a section of a perimeter of said bottom wall comprising its point less distant with respect to the opposite surface of the container.

4. The packaging according to claim 1, wherein said bottom wall extends from the opposite side with respect to said body in a thrust element adapted to interact with said closing element to remove it or break it, said thrust element being housed in said bottom interspace in said first retracted position.

5. The packaging according to claim 4, wherein said closing element consists of a disc fastened to a perimeter of said end of the bush along a weakened band, said thrust element comprising a cylindrical appendix substantially shaped like the beak of a flute and adapted to cut said closing element at said weakened band.

6. The packaging according to claim 1, wherein an end of said body of the receptacle turned towards the outside of said container is open, and including a shutter, and a collar for stopping the sliding of the receptacle adapted by resting on said bush.

7. The packaging according to claim 1, including a removable cap for covering said mouth which is threadingly coupled with said container, an inner surface of a crown of said cap being associated at an end turned towards the outside of said container of said sliding receptacle, the sliding of said sliding receptacle towards the inside of said container being generated by the screwing up of said cap on said container.

8. The packaging according to claim 7, wherein said cap comprises an inner cavity adapted to couple by slotting into a corresponding tooth defined as protruding at the end turned towards the outside of the container of said bush, following the complete screwing up said bush being removed from said mouth integrally with said cap by unscrewing of the latter.

9. The packaging according to claim 7, wherein said cap comprises a seal ring which is temporarily fastened thereto along a breakable line and which is temporarily fastened to said container.

10. The packaging according to claim 9, wherein said seal ring has an inner diameter bigger than an outer diameter of said cap, between said seal ring and said cap a fixing coupling being defined adapted to couple up following the complete screwing up of said cap.

11. The packaging according to claim 10, wherein said fixing coupling comprises a raised part defined as protruding from the outer side surface of said cap and a corresponding groove being defined inside said seal ring.

12. The packaging according to claim 1, wherein a handgrip is defined on the outer side surface of the end turned towards the outside of said container of said bush.

* * * * *